United States Patent [19]

Takagi et al.

[11] 4,149,377

[45] Apr. 17, 1979

[54] INTERNAL COMBUSTION ENGINE WITH EMISSION CONTROL SYSTEMS

[75] Inventors: Yasuo Takagi, Yokohama; Yasuo Nakajima, Yokosuka; Kunihiko Sugihara; Takashi Hisatomi, both of Yokohama, all of Japan

[73] Assignee: Nissan Motor Company, Limited, Yokohama, Japan

[21] Appl. No.: 799,161

[22] Filed: May 23, 1977

[30] Foreign Application Priority Data

May 24, 1976 [JP] Japan ..... 51-58996

[51] Int. Cl.[2] ..... F02M 25/06; F01N 3/10

[52] U.S. Cl. ..... 60/278; 60/290; 60/305; 123/119 A

[58] Field of Search ..... 60/278, 305, 290; 123/119 A

[56] References Cited

U.S. PATENT DOCUMENTS

| | | | |
|---|---|---|---|
| 3,172,251 | 3/1965 | Johnson | 60/278 |
| 3,948,044 | 4/1976 | Wakita | 60/278 |
| 3,978,834 | 9/1976 | Arnaud | 123/119 A |
| 3,983,697 | 10/1976 | Goto | 60/278 |
| 3,992,878 | 11/1976 | Moorman | 60/278 |
| 4,056,933 | 11/1977 | Nohira | 60/278 |

*Primary Examiner*—Douglas Hart

*Attorney, Agent, or Firm*—Schwartz, Jeffery, Schwaab, Mack, Blumenthal & Koch

[57] ABSTRACT

Disclosed is an automotive multi-cylinder internal combustion engine in which exhaust gases from one or more of the exhaust ports of the engine cylinders are partially recirculated into the mixture induction system of the engine and secondary air is injected into exhaust gases from the remaining exhaust ports under normal operating conditions of the engine. The recirculation of the exhaust gases is interrupted and furthermore secondary air is injected into the exhaust gases from all the engine cylinders under predetermined non-normal operating conditions such as idling and decelerating conditions of the engine.

19 Claims, 6 Drawing Figures

INTERNAL COMBUSTION ENGINE WITH EMISSION CONTROL SYSTEMS

FIELD OF THE INVENTION

The present invention relates in general to internal combustion engines for automotive use and particularly to an automotive multi-cylinder internal combustion engine of the character which is equipped with an exhaust-gas recirculation system and a secondary-air injection system for emission control purposes.

BACKGROUND OF THE INVENTION

An exhaust-gas recirculation system for use in an automotive internal combustion engine is well known per se and is generally adapted to recirculate the exhaust gases of the power cylinders of an internal combustion engine into the mixture induction system of the engine usually at a controlled rate. An emission control system of this type is useful primarily for the reduction of toxic nitrogen oxides to be produced as a result of the combustion of an air-fuel mixture in the combustion chambers of an internal combustion engine. On the other hand, a secondary-air injection system is adapted to inject secondary air into the exhaust gases in the exhaust system of an internal combustion engine usually at a controlled rate so as to promote the re-combustion or "afterburning" of toxic combustible residues such as hydrocarbons and carbon monoxide contained in the exhaust gases discharged from the combustion chambers of the engine. An emission control system of this particular nature is also well known per se and is useful for the control of hydrocarbon and carbon monoxide emissions especially when used in combination with positive exhaust-gas reoxidizing means such as a thermal reactor provided in the exhaust system of an internal combustion engine.

With a view to reducing all of the above-mentioned types of air contaminants, viz., nitrogen oxides, hydrocarbons and carbon monoxide in the exhaust emissions of an internal combustion engine, some modernized automotive internal combustion engines use both the exhaust-gas recirculation systems and the secondary-air injection systems. In order that the exhaust-gas recirculation and secondary-air injection systems thus incorporated in combination into an internal combustion engine be enabled to fully exhibit their respective potential performance efficiencies, it is a matter of prime importance where the exhaust-gas inlet port of the former system and the secondary-air outlet port of the latter system should be located in the exhaust system of the engine. If, for example, the secondary-air outlet port is located upstream of the exhaust-gas inlet port, the exhaust gases to be recirculated into the mixture induction system of the engine contain in a certain proportion the air which has not been consumed in the process of recombustion in the exhaust system upstream of the exhaust-gas inlet port. This causes excessive dilution of the air-fuel mixture to be produced in the mixture induction system of the engine and gives rise to an increase in the concentration of nitrogen oxides in the exhaust gases to be emitted from the combustion chambers of the engine. If, conversely, the exhaust-gas inlet port of the exhaust-gas recirculation system is located in the exhaust system upstream of the secondary-air outlet port of the secondary-air injection system, then the problem above pointed out would be solved but there is encountered a problem that the efficiency at which the exhaust gases are to be re-combusted with the aid of the secondary air in the exhaust system tends to be critically impaired. If, in this instance, the exhaust system is arranged with positive exhaust-gas re-oxidizing means such as a thermal reactor, the secondary air is admixed with the exhaust gases which have been processed in such re-oxidizing means and, as a corollary, the provision of the secondary-air injection system could not bring significant results.

To avoid these problems resulting from the above described port arrangements of the exhaust-gas recirculation and secondary-air injection systems, the exhaust-gas inlet port may be disposed to be open directly to the exhaust port of one of the power cylinders of an engine. As will be explained in more detail, however, such a port arrangement necessitates a disproportionately large-sized construction of an engine body and is not acceptable from a practical point of view.

The present invention therefore contemplates elimination of all the above described drawbacks of the ordinarily conceivable port arrangements of the exhaust-gas recirculation and secondary-air injection systems incorporated in combination into an automotive internal combustion engine.

It is, accordingly, an important object of the present invention to provide an automotive multi-cylinder internal combustion engine featuring the combination of exhaust-gas recirculation and secondary-air injection systems which are arranged to be capable of fully exhibiting their respective potential performance efficiencies.

It is another important object of the present invention to provide an automotive multi-cylinder internal combustion engine equipped with exhaust-gas recirculation and secondary-air injection systems which are arranged in such a manner that the operation of each of the systems is not affected or impaired by the operation of the other system.

Yet, it is another important object of the present invention to provide an automotive multi-cylinder internal combustion engine having emission control systems which are capable of reducing nitrogen oxide, hydrocarbon and carbon monoxide emissions of the engine to satisfactory degrees substantially throughout various modes of operation of the engine.

SUMMARY OF THE INVENTION

In accordance with the present invention, these and other objects will be accomplished basically in an automotive multi-cylinder internal combustion engine including a plurality of power cylinders each having a valved exhaust port, and an air-fuel mixture induction system for feeding an air-fuel mixture to the power cylinders of the engine, comprising, in combination, a first exhaust-gas passageway leading from the exhaust port of at least one of the power cylinders, a second exhaust-gas passageway leading from the exhaust ports of the remaining power cylinders, the first and second exhaust-gas passageways downstream merging with each other, an exhaust-gas recirculation passageway for providing communication between the first exhaust-gas passageway and the mixture induction system, the exhaust-gas recirculation passageway originating in an exhaust-gas inlet port which is open to the first exhaust-gas passageway, a secondary-air feed passageway terminating in a secondary-air outlet port which is open to the second exhaust-gas passageway, first control means for interrupting the communication between the exhaust-gas inlet port and the mixture induction system through the exhaust-gas recirculation passageway in response to predetermined operational conditions of the engine, and second control means for providing variable communication between the secondary-air feed passageway and the first exhaust-gas passageway in response to the above-mentioned predetermined operational conditions of the engine. The predetermined operational conditions of the engine as above-mentioned are, preferably, the idling condition and the decelerating condition of the engine.

DESCRIPTION OF THE DRAWINGS

The objects, features and advantages of an automotive internal combustion engine according to the present invention as basically constructed and arranged as above described will be more clearly understood from the following detailed description taken in conjunction with the accompanying drawings, in which.

DETAILED DESCRIPTION OF THE PRIOR ART

Figure 1:
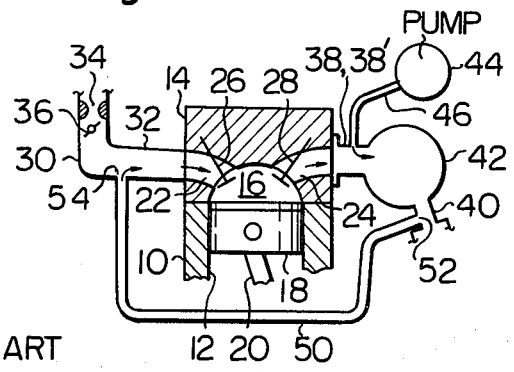
Fig. 1 PRIOR ART
FIG. 1 is a schematic sectional view showing part of an example of a prior-art automotive multi-cylinder internal combustion engine of the type equipped with both an exhaust-gas recirculation system and a secondary-air injection system for emission control purposes.

Referring first to FIG. 1 of the drawings, a prior-art automotive internal combustion engine arranged with an exhaust-gas recirculation system and a secondary-air injection system is shown comprising an engine body consisting of a cylinder block 10 formed with a cylinder bore 12 and a cylinder head 14 formed with a combustion chamber 16 above the cylinder bore 12. A reciprocating piston 18 is movable up and down in the cylinder bore 12 and is connected by a connecting rod 20 to an engine crankshaft (not shown) as is customary. The cylinder head 14 is further formed with intake and exhaust ports 22 and 24 which are open past intake and exhaust valves 26 and 28, respectively, to the combustion chamber 16. The cylinder bore 12, combustion chamber 16, valved intake and exhaust ports 22 and 24 thus arranged constitute a power cylinder of the engine, the power cylinder being one of a plurality of such cylinders.

The internal combustion engine shown in FIG. 1 further comprises an air-fuel mixture induction system consisting of a carburetor 30 and an intake manifold 32 through which the carburetor 30 is in communication downstream with the respective intake ports of the individual power cylinders. The carburetor 30 is shown comprising a venturi 34 and a throttle valve 36 located downstream of the venturi 34. Though not shown, the carburetor 30 further comprises a fuel discharge nozzle projecting into the venturi 34 so that fuel metered into the fuel delivery circuit (not shown) of the carburetor is injected through the fuel discharge nozzle into the venturi 34 and is mixed with air passed through the venturi 34 under normal operating conditions of the engine when the throttle valve 36 is open. The motivating force causing the fuel to be injected into the venturi 34 is the partial vacuum which is developed in the venturi as is well known in the art, such a vacuum being herein referred to as venturi vacuum. As is also well known, the throttle valve 36 is mechanically connected to the accelerator pedal (not shown) of the vehicle and is driven to move between a full throttle position and a fully closed position. When the throttle valve 36 is in the fully closed position, there is formed a small gap between an edge portion of the throttle valve 36 and an internal wall surface of the carburetor 30 so that a certain degree of vacuum is built up immediately upstream of such a gap. The partial vacuum thus developed immediately upstream of the throttle valve 36 is herein referred to as VC (valve-closed) vacuum. Besides the venturi vacuum and VC vacuum thus developed in the carburetor upstream of the throttle valve 36, there is an intake manifold vacuum which is developed in the intake manifold 32 and accordingly in the carburetor 30 downstream of the throttle valve 36. As is well known in the art, the intake manifold vacuum varies primarily with the angular position of the throttle valve 36 substantially throughout the operation of the engine and culminates under idling condition of the engine when the throttle valve 36 is held in the fully or nearly fully closed position thereof.

In FIG. 1, the prior-art internal combustion engine is further shown comprising an exhaust system which consists of a pair of separate branch passageways 38 and 38' and a plenum passageway 40. The branch passageways 38 and 38' debouch downstream into a thermal reactor 42, and the plenum passageway 40 extends from the thermal reactor 42. Though not shown, one of the branch passageways 38 and 38' is in communication with the exhaust ports of some of the power cylinders of the engine and the other branch passageway is in communication with the exhaust ports of the other power cylinders of the engine, while the plenum passageway 40 is downstream open to the atmosphere through an exhaust tube and an exhaust tail pipe.

Figure 2:
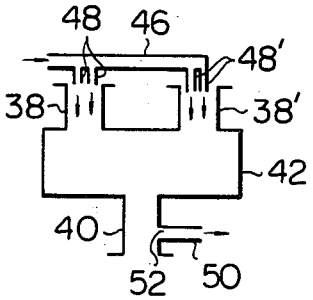
Fig. 2 PRIOR ART
FIG. 2 is a diagrammatic view showing an arrangement in which the exhaust-gas inlet port and the secondary-air outlet port of the emission control systems of the internal combustion engine are disposed in the exhaust system of the engine.

With the exhaust system of the engine thus arranged, the secondary-air injection system is shown comprising an engine-driven air delivery pump 44 (FIG. 1), a secondary-air feed passageway 46 leading from the pump 44 and terminating in air-injection nozzles 48 open into the first branch passageway 38 of the exhaust system and air-injection nozzles 48' which are open into the second branch passageway 38' of the exhaust system as shown in FIG. 2. Fresh air delivered from the pump 44 and passed through the secondary-air feed passageway 46 is thus injected through the nozzle 48 and 48' into the exhaust gases which are entering the thermal reactor 42 through the branch passageways 38 and 38' of the exhaust system. On the other hand, the exhaust-gas recirculation system comprises an exhaust-gas recirculation passageway 50 which is shown having an exhaust-gas inlet port 52 open to the above-mentioned plenum passageway 40 of the exhaust system and an exhaust-gas outlet port 54 which is open to the interior of the intake manifold 32 of the mixture induction system, as shown in FIG. 1. The exhaust gases which have been processed in the thermal reactor 42 and are cleared of combustible residues of hydrocarbons and carbon monoxide are thus recycled through the exhaust-gas recirculation passageway 50 into the intake manifold 32 of the mixture induction system at a rate which is varied in accordance with suitable operational variables of the engine such as the air-to-fuel ratio of the mixture delivered to the engine cylinders.

In the prior-art emission control arrangement illustrated in FIGS. 1 and 2, the air-injection nozzles 48 and 48' of the secondary-air injection system are open into the exhaust system upstream of the thermal reactor 42. The exhaust gases which are discharged from the exhaust ports of the power cylinders of the engine are therefore mixed with the secondary air prior to entering the thermal reactor 42 and are re-combusted in the thermal reactor 42 with the aid of the secondary air injected into the passageways 38 and 38' upstream of the thermal reactor 42. The exhaust-gas inlet port 52 of the exhaust-gas recirculation system being located downstream of the thermal reactor 42, the exhaust gases passed through the exhaust-gas recirculation passageway 50 into the intake manifold 32 of the induction system contain in a certain proportion excess air which has not been consumed in the process of the recombustion of the exhaust gases in the thermal reactor 42. The excess air causes excessive dilution of the air-fuel mixture to be delivered to the power cylinders of the engine through the intake manifold 32. The unduly lean air-fuel mixture not only gives rise to an increase in the concentration of nitrogen oxides produced in the combustion chambers of the engine but will upset the air-to-fuel ratio of the mixture which has been produced from air and fuel strictly metered in the air and fuel delivery circuits (not shown) of the carburetor 30 under the control of a mixture control system (not shown) which is usually attached to the carburetor for emission control purposes.

These problems encountered in the emission control arrangement shown in FIGS. 1 and 2 will be solved if the secondary-air injection system is arranged in such a manner as to have an air-injection nozzle or nozzles open into the exhaust system downstream of the exhaust-gas inlet port 52 of the exhaust-gas recirculation system so that the exhaust gases to be recirculated into the induction system are not allowed to mix with the secondary air injected into the exhaust gases. Such an advantage is, however, not only offset by the reduction of the exhaust-gas re-combustion efficiency to be achieved by having recourse to the use of secondary air in the exhaust system and will as a consequence invite increases in the concentrations of unburned combustible residues in the exhaust gases to be discharged from the exhaust gases. Where, furthermore, the exhaust system is of the type using positive exhaust-gas re-oxidizing means such as a thermal reactor as in the internal combustion engine illustrated in FIGS. 1 and 2, locating the air outlet port or ports of a secondary-air injection system downstream of the re-oxidizing means is apparently adverse to the purpose for which such a system is put to use.

Figure 3:
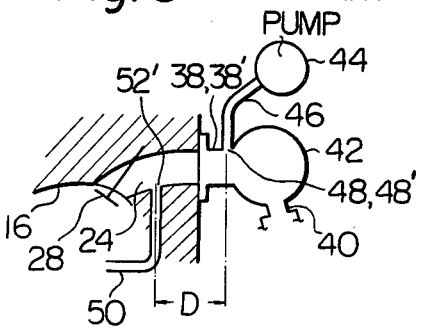
Fig. 3 PRIOR ART
FIG. 3 is a view showing part of another example of a prior-art automotive multi-cylinder internal combustion engine of the type equipped with exhaust-gas recirculation and secondary-air injection systems.
Figure 4:
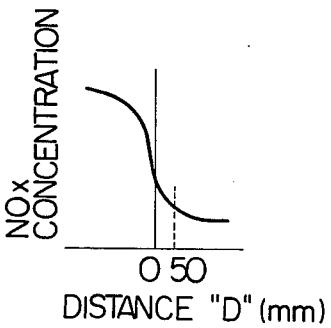
FIG. 4 is a graphic representation of a general relationship between the relative positions of the exhaust-gas inlet and secondary-air outlet ports and the concentration of nitrogen oxides produced in an automotive internal combustion engine equipped with exhaust-gas recirculation and secondary-air injection systems.

The inlet port of an exhaust-gas recirculation system may be disposed to be open to the exhaust port of one of the power cylinders so that the port is located upstream of the air outlet port or ports of the secondary-air injection system as in the arrangement illustrated in FIG. 3 in which the exhaust-gas recirculation passageway 50 is shown to originate in an exhaust-gas inlet port 52' which is open to the exhaust port 24 of one of the power cylinders of an internal combustion engine. Experiments have been conducted by the inventors with various internal combustion engines arranged with exhaust-gas recirculation and secondary-air injection systems in an effort to determine the general relationship between the port-to-port distance D between the inlet port of the exhaust-gas recirculation system and the outlet port of the secondary-air injection system of an internal combustion engine and the concentration of nitrogen oxides contained in the exhaust gases finally discharged from the exhaust system of the engine. FIG. 4 shows the results of such experiments, wherein the chart uses the port-to-port distance D in millimeters as abscissas and the concentrations of nitrogen oxides ($NO_x$) as ordinates and wherein the origin O represents the location of the outlet ports of the secondary-air injection systems. The region indicated by the plus sign "+" thus shows that the inlet ports of the exhaust-gas recirculation systems are located in the exhaust systems upstream of the outlet ports of the secondary-air injection systems and the region indicated by the minus sign "−" shows that the inlet ports of the exhaust-gas recirculation systems are disposed in the exhaust systems downstream of the outlet ports of the secondary-air injection systems. The shown results of the experiments were obtained when the engines with the carburetors operated to produce air-to-fuel ratios approximating 14:1 and with the exhaust-gas recirculation and secondary-air injection systems arranged to produce combustible mixture containing 20 percent by weight of recirculated exhaust gases at the final stages of the mixture induction systems and exhaust gases diluted with secondary-air of quantities resulting in secondary-air dilution factors of 1.08 (the ratios of the sums of the quantities of intake and secondary air to the quantities of intake air) were operated to produce output powers with revolution speeds of 1600 rpm and driving torques of 9 kg-m. From the curve shown in FIG. 4 it will be seen that the concentrations of nitrogen oxides in the exhaust gases to be discharged from the exhaust systems of internal combustion engines cannot be reduced to satisfactory degrees unless the inlet ports of the exhaust-gas recirculation systems are located in the exhaust systems downstream of the outlet ports of the secondary-air injection systems at distances D of over 50 millimeters. If the distance between the outlet port of the secondary-air injection system and the exhaust-gas inlet port which is located upstream of the secondary-air outlet port is less than 50 millimeters, the secondary-air injected into the exhaust gases downstream of the exhaust-gas inlet port is allowed to mix with the exhaust gases entering the exhaust-gas inlet port because the exhaust gases are caused to periodically flow backwardly due to the pulsations in the pressure of the exhaust gases between over-atmospheric and subatmospheric levels.

Designing an internal combustion engine in such a manner that the above-mentioned port-to-port distance D is over 50 millimeters is objectionable not only from a view point of reducing the overall dimensions of the engine but because of the fact that the more remote the secondary-air outlet port from the exhaust port, the lower the temperature of the exhaust gases that are to be re-combusted with the aid of the secondary air.

The primary object of the present invention is to provide a useful and economical solution to these problems which have been or may be experienced in an automotive internal combustion engine using both an exhaust-gas recirculation system and a secondary-air injection system for emission control purposes, as previously noted.

DESCRIPTION OF PREFERRED EMBODIMENTS

Figure 5:
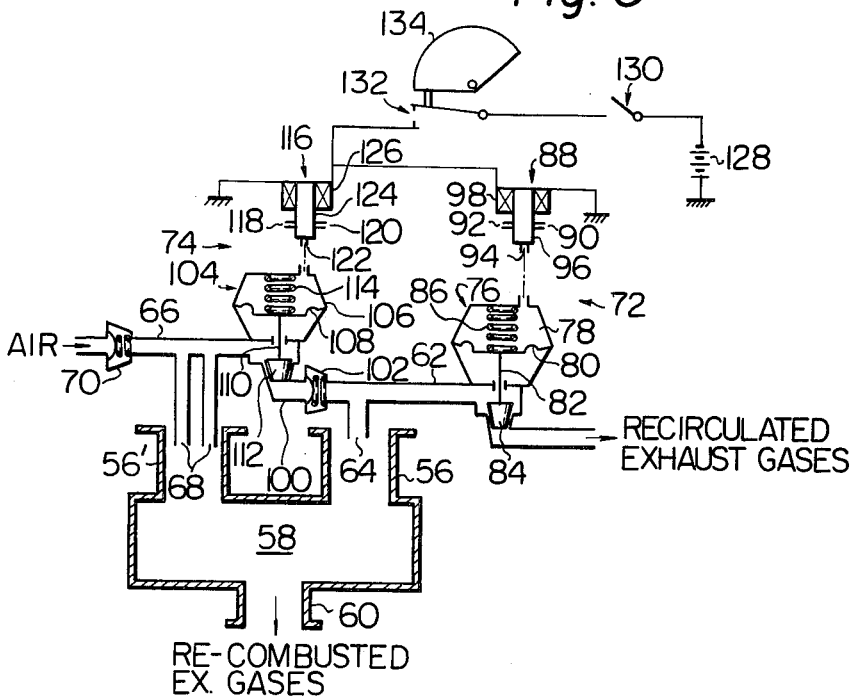
FIG. 5 is a schematic view showing, largely in section, emission control systems forming part of a preferred embodiment of an automotive internal combustion engine according to the present invention.

Referring to FIG. 5, there are shown general setups of exhaust-gas recirculation and secondary-air injection systems forming part of a preferred embodiment of an automotive multiple-cylinder internal combustion engine according to the present invention. Though not shown in FIG. 5, the internal combustion engine installed with the shown emission control systems includes a plurality of power cylinders each constructed and arranged in a usual fashion and thus having a valved exhaust port as shown in FIG. 1 and an air-fuel mixture induction system for feeding an air-fuel mixture to the power cylinders. The details of the construction and arrangement of such an internal combustion engine are well known in the art and are not herein illustrated.

The internal combustion engine embodying the present invention further comprises an exhaust system including first and second exhaust-gas passageways 56 and 56' and a plenum chamber 58 in which the exhaust-gas passageways 56 and 56' terminate downstream and which has an outlet port 60. The first exhaust-gas passageway 56 is in communication upstream with the exhaust port or ports of one or more of the power cylinders of the engine and the second exhaust-gas passageway 56' is upstream in communication with the exhaust ports of the remaining power cylinders. Thus, the exhaust gases discharged from one of or one group of power cylinders are directed to the plenum chamber 58 by way of the first exhaust-gas passageway 56 and the exhaust gases discharged from the other group of power cylinders are directed to the plenum chamber 58 by way of the second exhaust-gas passageway 56'. The streams of the exhaust gases separately passed through the first and second exhaust-gas passageways 56 and 56' are mixed together in the plenum chamber 58 and are re-combusted in the plenum chamber 58 with the aid of secondary air directed into the plenum chamber 58 as will be described. While the plenum chamber 58 may be constituted by the plenum portion of the exhaust manifold of a usual exhaust system, the chamber 58 is herein assumed to form part of a thermal reactor for purposes of description. The construction and arrangement of thermal reactors in general are also well known in the art and are rather immaterial to the understanding of the present invention and, as such, the construction of the thermal reactor constituting the plenum chamber 58 is not herein shown. The outlet port 60 of the plenum chamber 58 thus constituted by the thermal reactor is in communication with an exhaust pipe which is open to the atmosphere through a muffler or mufflers and an exhaust tail pipe as is customary in the art, and is therefore not shown.

The exhaust-gas recirculation system for use with the exhaust system constructed and arranged in this fashion comprises an exhaust-gas recirculation passageway 62 with originates in an exhaust-gas inlet port 64 open to the first exhaust-gas passageway 56 of the exhaust system and which terminates, though not shown in FIG. 5, in an exhaust gas outlet port or nozzle which is open into the induction system of the engine as shown at 54 in FIG. 1. On the other hand, the secondary-air injection system to be in use with the exhaust-gas recirculation system comprises a secondary-air feed passageway 66 which originates in a suitable source (not shown) of air under pressure such as an engine-driven air delivery pump and terminates in air-injection nozzles 68 projecting into the second exhaust-gas passageway 56' of the exhaust system. By preference, the secondary-air feed passageway 66 is provided with a spring-loaded one-way check valve 70 for preventing a reverse flow of air in the passageway 66 as would otherwise be caused by an over-atmospheric pressure to be developed in the exhaust-gas passageway 56' into which the air-injection nozzles 68 project.

The emission control arrangement illustrated in FIG. 5 further comprises first control means 72 for interrupting the communication between the inlet port 64 of the exhaust-gas recirculation passageway 62 and the mixture induction system of the engine in response to predetermined operational conditions of the engine and second control means 74 for providing variable communication between the secondary-air feed passageway 66 and the first exhaust-gas passageway 56' of the exhaust system in response to the predetermined operational conditions of the engine.

The first control means 72 comprises a first diaphragm-operated valve assembly 76 including a variable-volume control chamber 78 which has one end defined by a flexible diaphragm 80. An elongated valve stem 82 is connected at one end to the diaphragm 80 and axially extends in a direction opposite to the control chamber 78. The valve stem 82 projects into the exhaust-gas recirculation passageway 62 and carries at the other end thereof a frusto-conical valve head 84 which is adapted to continuously move in the passageway 62 between a first position providing a maximum flow through the passageway 62 and a second position fully closing the passageway 62 as shown. The valve head 84 is urged to move toward the second position thereof by suitable biasing means such as a preloaded helical compression spring 86 which is mounted within the control chamber 78 and which is seated at one end on the inner face of the diaphragm 80. The diaphragm 80 is thus urged to partially move toward a position expanding the control chamber 78 into the maximum-volume condition thereof and accordingly causing the valve head 84 to assume the second position thereof. The first control means 72 further comprises a first solenoid-operated two-position valve unit 88 having a vacuum inlet port 90, an air inlet port 92 and a control port 94. The air port 92 is open to the atmosphere and the vacuum port 90 is in communication with a suitable source of control vacuum with which the exhaust-gas recirculation rate is to be varied, such a control vacuum being preferably either of the previously mentioned venturi vacuum or VC vacuum. The control port 94 is in communication with the control chamber 78 of the diaphragm-operated valve assembly 76. The solenoid-operated valve unit 88 further comprises a plunger 96 and a solenoid coil 98 which is arranged in surrounding relationship to the plunger 96. The plunger 96 is axially movable between a first position providing communication between the vacuum port 90 and the control port 94 and a second position providing communication between the air port 92 and the control port 94 and is biased to axially move toward the first position thereof. When the solenoid coil 98 remains de-energized, the plunger 96 is thus held in the first position thereof providing communication between the vacuum and control ports 90 and 94 so that a vacuum substantially equal to the venturi or VC vacuum is developed in the control chamber 78 of the diaphragm-operated valve assembly 76 through the vacuum and control ports 90 and 94 of the valve unit 88. When the solenoid coil 98 is energized, the plunger 96 is axially moved into the second position thereof providing communication between the air port 92 and the control port 94 so that atmospheric air is admitted through the air and control ports 92 and 94 of the valve unit 88 into the control chamber 78 of the diaphragm-operated valve assembly 76.

On the other hand, the second control means 74 comprises an intermediate passageway 100 having one end merging out of the secondary-air feed passageway 66 and the other end communicating with the inlet port 64 of the exhaust-gas recirculation passageway 62. A spring-loaded one-way check valve 102 is provided in the intermediate passageway 100 so as to prevent a backward flow from the inlet port 64 of the exhaust-gas recirculation passageway 62 into the secondary-air feed passageway 66. The second control means 74 further comprises a second diaphragm-operated valve assembly 104 including a variable-volume control chamber 106 which has one end defined by a flexible diaphragm 108. An elongated valve stem 110 is connected at one end to the diaphragm 108 and axially extends in a direction opposite to the control chamber 106. The valve stem 110 projects into the above-mentioned intermediate passageway 100 and carried at the other end thereof a frusto-conical valve head 112 which is adapted to move in the passageway 100 between a first position fully closing the passageway 100 as shown and a second position providing a maximum flow through the passageway 100. The valve head 112 is urged to move toward the first position thereof by suitable biasing means such as a preloaded helical compression spring 114 which is mounted within the control chamber 106 and which is seated at one end on the inner face of the diaphragm 114. The diaphragm 114 is thus urged to partially move toward a position expanding the control chamber 106 into the maximum-volume condition thereof and accordingly causing the valve head 112 to assume the first position thereof. The second control means 74 further comprises a second solenoid-operated valve unit 116 having an air inlet port 118, a vacuum inlet port 120 and a control port 122. The air inlet port 118 is open to the atmosphere and the vacuum port 120 is in communication with the mixture induction system of the engine downstream of the throttle valve. The control port 122 is in communication with the control chamber 106 of the diaphragm-operated valve assembly 104. The solenoid-operated valve unit 116 further comprises a plunger 124 and a solenoid coil 126 which is arranged in surrounding relationship to the plunger 124. The plunger 124 is axially movable between a first position providing communication between the air port 118 and the control port 122 and a second position providing communication between the vacuum port 120 and the control port 122 and is biased to axially move toward the first position thereof. When the solenoid coil 126 remains de-energized, the plunger 124 is thus held in the first position thereof providing communication between the air and control ports 118 and 122 so that atmospheric air is admitted into the control chamber 106 of the diaphragm-operated valve assembly 104 through the air and control ports 118 and 122 of the valve unit 116. When the solenoid coil 126 is energized, the plunger 124 is axially moved into the second position thereof providing communication between the vacuum and control ports 120 and 122 so that a vacuum substantially equal to the vacuum developed in the intake manifold of the induction system is built up in the control chamber 106 of the diaphragm-operated valve assembly 104 through the vacuum and control ports 120 and 122 of the valve unit 116.

The respective solenoid coils 98 and 126 of the solenoid-operated valve units 88 and 116 are connected in series with a d.c. power source 128 across a series combination of an ignition switch 130 and an engine-load responsive switch 132. The engine-load responsive switch 132 is adapted to open when the engine is being operated in medium to high load conditions and to close in response to low-load operating conditions such as the idling and decelerating conditions of the engine. The engine-load responsive switch 132 is herein assumed by way of example to be operated by a switch actuator 134 which is connected to the accelerator pedal (not shown) of the vehicle or to the mechanical linkage interconnecting the accelerator pedal and the carburetor throttle valve and which is arranged in such a manner as to be moved into a position closing the engine-load responsive switch 132 when the accelerator pedal is held in a rest position producing an idling condition in the engine or is slightly depressed from the rest position for producing a decelerating condition in the engine.

In operation, the ignition switch 130 is closed and the engine-load responsive switch 132 is open when the engine is operating under normal conditions. The respective solenoid coils 98 and 126 of both of the solenoid-operated valve units 88 and 118 are kept de-energized. Thus, the plunger 96 of the solenoid-operated valve unit 88 is held in the first position thereof providing communication between the vacuum port 90 and the control port 94 so that a vacuum substantially equal to the venturi or VC vacuum is established in the control chamber 78 of the diaphragm-operated valve assembly 76. The vacuum thus developed in the control chamber 78 acts on the diaphragm 80 and moves the diaphragm 80 in a direction to contract the control chamber 78 against the force of the compression spring 86 with the result that the valve head 84 connected by the valve stem 82 to the diaphragm 80 is moved away from the second position and provides in the exhaust-gas recirculation passageway 62 a flow rate which is substantially proportional to the venturi or VC vacuum in the mixture induction system of the engine. The exhaust gases entering the plenum chamber or thermal reactor 58 through the first exhaust-gas passageway 56 of the exhaust system and partially admitted into the exhaust-gas recirculation passageway 62 through the inlet port 64 of the passageway 62 are allowed to flow past the valve head 84 at a rate varying substantially in proportion to the venturi or VC vacuum in the mixture induction system of the engine. The solenoid coil 126 of the other solenoid-operated valve unit 104 being kept deenergized, the plunger 124 of the valve unit 104 is also held in the first position thereof and provides communication between the air port 118 and the control port 122 of the valve unit 104. Atmospheric air is thus admitted into the control chamber 106 of the diaphragm-operated valve assembly 104 through the air and control ports 118 and 122 of the valve unit 104 so that the diaphragm 108 of the valve assembly 104 is held in a position expanding the control chamber 106 to the maximum-volume condition thereof by the force of the compression spring 114. The valve head 112 of the valve assembly 104 is therefore held in the first position thereof closing the intermediate passageway 100 and accordingly isolating the inlet port 64 of the exhaust-gas recirculation passageway 62 from the secondary-air feed passageway 66. The secondary air which is pumped into the secondary-air feed passageway 66 is admitted into the plenum chamber or thermal reactor 58 only through the air injection nozzles 68 which are open into the second exhaust-gas passageway 56' of the exhaust system.

When the engine is being operated under idling or decelerating conditions, both the ignition switch 130 and the engine-load responsive switch 132 are closed and accordingly the respective solenoid coils 98 and 126 of both of the solenoid-operated valve units 88 and 116 are energized. The plunger 96 of the solenoid-operated valve unit 88 is now moved to the second position thereof providing communication between the air and control ports 92 and 94 of the valve unit 88 so that atmospheric air is admitted through these ports 92 and 94 into the control chamber 78 of the diaphragm-operated valve assembly 76. The diaphragm 80 of the valve assembly 76 is therefore allowed to move into the position expanding the control chamber 78 to the maximum-volume condition thereof by the force of the compression spring 86 and accordingly moving the valve head 84 to the second position thereof fully closing the exhaust-gas recirculation passageway 62, thereby blocking the communication between the first exhaust-gas passageway 56 and the mixture induction system of the engine. The solenoid coil 126 of the other solenoid-operated valve unit 116 being energized, the plunger 124 of the valve unit 116 is also moved to the second position thereof and provides communication between the vacuum and control ports 120 and 122 of the valve unit 104. The valve head 112 connected to the diaphragm 108 of the valve unit 104 is therefore moved to the position opening the intermediate passageway 100 and accordingly providing communication between the secondary-air feed passageway 66 and the inlet port 64 of the exhaust-gas recirculation passageway 62 through the intermediate passageway 100 so that the secondary air in the secondary-air feed passageway 66 is injected not only into the second exhaust passageway 56' through the air-injection nozzles 68 but into the first exhaust-gas passageway 56 through the one-way check valve 102 and the inlet port 64 of the exhaust-gas recirculation passageway 62. During idling or deceleration of the engine, therefore, the recirculation of the exhaust gases into the mixture induction system of the engine is interrupted with the exhaust-gas recirculation passageway 62 closed by the valve head 84 of the diaphragm-operated valve assembly 76 and, at the same time, the secondary air in the secondary-air passageway 66 is injected into the exhaust gases entering the plenum chamber or thermal reactor 58 through both of the first and second exhaust-gas passageways 56 and 56'.

Figure 6:
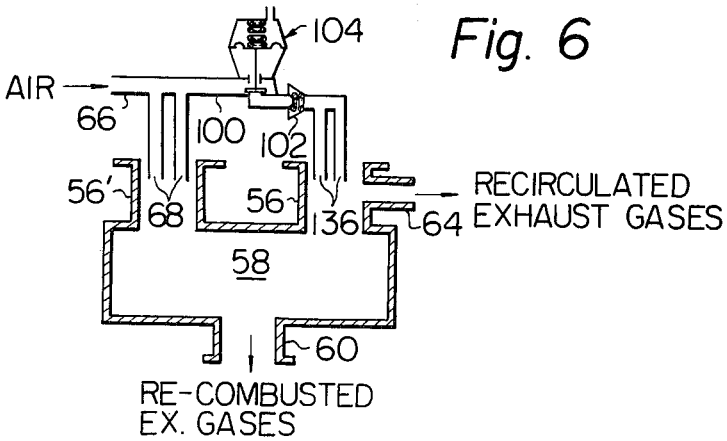
FIG. 6 is a schematic sectional view showing part of a modification of the emission control arrangement illustrated in FIG. 5.

To lessen the thermal loads to which the second control means 74 will be subjected by the heat of the exhaust gases passed through the exhaust-gas recirculation passageway 62 communicating with the intermediate passageway 100, the intermediate passageway 100 forming part of the control means 74 may be arranged separately of the exhaust-gas recirculation passageway 62 so that the intermediate passageway 100 has air injection nozzles 136 projecting into the first exhaust-gas passage-way 56 separately of the inlet port 64 of the exhaust-gas recirculation passageway 62 as shown in FIG. 6. The means to feed fresh air into the secondary-air feed passageway 66 has been assumed to be constituted by an engine-driven air-delivery pump but, if desired, may be constituted by a one-way check valve which is adapted to be periodically vented from the open air in response to subatmospheric pressures which are periodically built up in the exhaust system due to the pulsations in the exhaust pressure.

The emission control systems of an internal combustion engine according to the present invention being thus constructed and arranged, the following advantages are achieved over prior-art internal combustion engines of the described natures:

(1) The exhaust gases to be recirculated into the mixture induction system of an engine are prevented from being mixed with the secondary air injected into the exhaust fases to be combusted or with the residual air in the exhaust gases re-combusted. The exhaust gases are thus recirculated into the mixture induction system at a rate which is controlled independently of the rate at which secondary air is injected into the exhaust system. The potential function of the exhaust-gas recirculation system can therefore be fully exploited in reducing the concentrations of toxic exhaust emissions, particularly the concentration of nitrogen oxides.

(2) Where the mixture induction system is arranged with mixture ratio control means of the type adapted to control the air-to-fuel ratio of the mixture in accordance with a signal or signals fed back from the exhaust system to such control means, the secondary air carried over together with the recirculated exhaust gases into the mixture supplied from the carburetor upsets the composition of the exhaust gases resulting from such a mixture. The signal fed back to the mixture control means is therefore not a faithful representation of the air-fuel mixture produced in the carburetor and, as a consequence, the mixture ratio control means is disabled from properly controlling the air-to-fuel ratio of the mixture to be produced in the carburetor. In an internal combustion engine in which the exhaust gases recirculated into the mixture induction system are prevented from being excessively diluted with secondary air, such a problem is eliminated and accordingly the concentrations of toxic exhaust emissions can be reduced according to schedule.

(3) Since the exhaust gases are recirculated from the upstream side of the plenum chamber in which the re-combustion of the uncirculated exhaust gases is to take place, the exhaust gases to be re-combusted are passed through the plenum chamber in greater quantities and for longer periods of time than in an arrangement in which the exhaust gases are recirculated from the downstream side of the plenum chamber or thermal reactor. The exhaust gases in the thermal reactor are therefore given more chances of being oxidized into harmless compounds.

(4) Secondary air is injected into the exhaust gases at a maximum rate under idling and decelerating conditions of an engine when the recirculation of exhaust gases into the mixture induction system is interrupted. This is conducive to compensating for the temporary deterioration of the conversion efficiencies of hydrocarbons and carbon monoxide in the thermal reactor under the particular operational conditions of the engine.

What is claimed is:

1. An automotive multi-cylinder internal combustion engine, comprising: a plurality of power cylinders each having a valved exhaust port, an air-fuel mixture induction system including a venturi and a throttle valve for feeding an air-fuel mixture to the power cylinders of the engine, a first exhaust-gas passageway leading from the exhaust port of at least one of said power cylinders, a second exhaust-gas passageway leading from the exhaust ports of the remaining power cylinders, the first and second exhaust-gas passageways merging with each other downstream, an exhaust-gas recirculation passageway for providing communication between the first exhaust-gas passageway and said mixture induction system, the exhaust-gas recirculation passageway originating in an exhaust-gas inlet port which is open to the first exhaust-gas passageway, first means for feeding secondary air to said second exhaust-gas passageway, second means for feeding secondary-air to said first exhaust-gas passageway, first control means for interrupting the communication between said exhaust-gas inlet port and the mixture induction system through said exhaust-gas recirculation passageway in response to predetermined operational conditions of the engine, and second control means for operating said second feeding means to feed secondary-air to said first exhaust-gas passageway in response to said predetermined operational conditions of the engine.

2. An automotive multi-cylinder internal combustion engine as set forth in claim 1, in which said first control means comprises first diaphragm-operated valve means having a first position providing a maximum flow through said exhaust-gas recirculation passageway and a second position fully closing the exhaust-gas recirculation passageway the valve means being continuously operable between the first and second positions and being in the second position thereof in response to said predetermined operational conditions of the engine.

3. An automotive multi-cylinder internal combustion engine as set forth in claim 2, in which said first control means further comprises first solenoid-operated valve means having a first position providing communication between said diaphragm-operated valve means and a source of control vacuum developed in the mixture induction system upstream of the throttle valve and a second position providing communication between the atmosphere and said first diaphragm-operated valve means, the first and second positions of said solenoid-operated valve means producing the first and second positions, respectively, in the first diaphragm-operated valve means, the solenoid-operated valve means being in the second position thereof in response to said predetermined operational conditions of the engine.

4. An automotive multi-cylinder internal combustion engine as set forth in claim 3, further including means for applying as said control vacuum communicated to said diaphragm-operated valve means a vacuum substantially equal in magnitude to the vacuum developed in the venturi in the mixture induction system.

5. An automotive multi-cylinder internal combustion engine as set forth in claim 3, further including means for applying as said control vacuum communicated to said diaphragm-operated valve means a vacuum substantially equal magnitude to the vacuum developed immediately upstream of the throttle valve in its closed position in the mixture induction system.

6. An automotive multi-cylinder internal combustion engine as set forth in claim 1, in which said second control means comprises second diaphragm-operated valve means having a first position rendering said second feeding means inoperable to feed secondary-air to said first exhaust-gas passageway and a second position rendering said second feeding means operable to feed a secondary-air variably to said first exhaust-gas passageway, the second diaphragm-operated valve means being in the second position thereof in response to said predetermined operational conditions of the engine.

7. An automotive multi-cylinder internal combustion engine as set forth in claim 6, in which said second control means further comprises second solenoid-operated valve means having a first position providing communication between said second diaphragm-operated valve means and the atmosphere and a second position providing communication between the second diaphragm-operated valve means and a source of vacuum substantially equal to the vacuum developed in the mixture induction system of the engine downstream of the throttle valve thereof, the first and second positions of the second solenoid-operated valve means producing the first and second positions, respectively, in the second diaphragm-operated valve means, the second solenoid-operated valve means being in the second position thereof in response to said predetermined operational conditions of the engine.

8. An automotive multi-cylinder internal combustion engine, as set forth in claim 7, in which said second feeding means comprises an intermediate passageway for providing communication between said first feeding means and said first exhaust-gas passageway, said second diaphragm-operated valve means fully closing said intermediate passageway when in the first position thereof and providing a maximum flow through the intermediate passageway when in the second position thereof.

9. An automotive multi-cylinder internal combustion engine as set forth in claim 8, in which said intermediate passageway has one end merging out of said first feeding means and the other end opening through said exhaust-gas inlet port of said exhaust-gas recirculation passageway.

10. An automotive multi-cylinder internal combustion engine as set forth in claim 8, in which said intermediate passageway has one end merging out of said first feeding means and the other end directly opening into said first exhaust-gas passageway separately from said exhaust-gas inlet port of said exhaust-gas inlet port of said exhaust-gas recirculation passageway.

11. An automotive multi-cylinder internal combustion engine as set forth in claim 1, in which said predetermined operational conditions include idling and decelerating conditions of the engine.

12. An automotive multi-cylinder internal combustion engine as set forth in claim 1, in which said first and second control means comprise first and second diaphragm-operated valve means, respectively, the first diaphragm-operated valve means of the first control means being continuously operable between a first position providing a maximum flow through said exhaust-gas recirculation passageway and a second position fully closing the exhaust-gas recirculation passageway and the second valve means of the second control means having a first position rendering said second feeding means inoperable to feed secondary-air to said first exhaust-gas passageway and a second position rendering said second feeding means operable to feed secondary-air variably to said first exhaust-gas passageway, the first and second valve means of the first and second control means, respectively, being in the second position thereof in response to said predetermined operational conditions of the engine.

13. An automotive multi-cylinder internal combustion engine, as set forth in claim 12, in which said first and second control means further comprise first and second solenoid-operated valve means, respectively, the first solenoid-operated valve means of the first control means having a first position providing communication between the first diaphragm-operated valve means of the first control means and a source of control vacuum developed in the mixture induction system of the engine upstream of the throttle valve thereof and a second position providing communication between the atmosphere and said first diaphragm-operated valve means of the first control means and the second solenoid-operated valve means of the second control means having a first position providing communication between the atmosphere and the second diaphragm-operated valve means of the second control means and a second position providing communication between said second diaphragm-operated valve means of the second control means and a source of vacuum developed in the mixture induction system of the engine downstream of the throttle valve thereof, the first and second positions of the first and second solenoid-operated valve means of the first and second control means producing the first and second positions, respectively, in the diaphragm-operated valve means of each of the first and second control means, the first and second solenoid-operated valve means of the first and second control means being in the respective second positions thereof in response to said predetermined operational conditions of the engine.

14. An automotive multi-cylinder internal combustion engine as set forth in claim 13, in which said second feeding means comprises an intermediate passageway for providing communication between said first feeding means and said first exhaust-gas passageway, said second diaphragm-operated valve means of the second control means fully closing said intermediate passageway when in the first position thereof and providing a maximum flow through the intermediate passageway when in the second position thereof.

15. An automotive multi-cylinder internal combustion engine, as set forth in claim 13, in which the first and second solenoid-operated valve means of the first and second control means are electrically connected in series with a source of power across a switch responsive to variation in the load on the engine, the switch being open in response to medium to high load conditions of the engine and being closed in response to low-load conditions of the engine.

16. A control system for secondary air feed and exhaust gas recycle, for use in an automotive multi-cylinder internal combustion engine of the type including a plurality of power cylinders each having a valve exhaust port, and an air-fuel mixture induction system for feeding an air-fuel mixture to the power cylinders of the engine and having a throttle valve, said control system comprising in combination:

a first exhaust gas passageway leading from at least one of said power cylinders, a second exhaust gas passageway leading from the exhaust ports of the remaining power cylinders, said first and second exhaust gas passageways merging with each other, an exhaust gas recirculation passageway for providing communication between the first exhaust-gas passageway and the mixture induction system, the exhaust-gas recirculation passageway originating in an exhaust gas inlet port which is open to the first exhaust gas passageway, a secondary air feed passageway having an inlet for the secondary air and two outlet ports serially formed in said secondary air feed passageway, the first of said ports communicating with the first exhaust gas passageway and the second of said ports being located upstream of said first outlet port with respect to the direction of the secondary air flow and communicating with the second exhaust gas passageway, first control means for interrupting the communication between said exhaust gas inlet and the mixture induction system through said exhaust gas recirculation passageway in response to predetermined operational conditions of the engine, and second control means disposed in said secondary air passageway between said first and second outlets for normally blocking communication between the same while establishing communication between said first and second outlets to deliver the secondary air to both of said exhaust passageways in accordance with the predetermined operating conditions.

17. A control system according to claim 16, in which said secondary air feed passageway communicates with said exhaust gas recirculation passageway and with said first exhaust gas passageway via a one-way check valve allowing fluid flow only in a direction from said secondary air feed passageway to said exhaust gas recirculation passageway.

18. A control system according to claim 16, in which said secondary air feed passageway is separated from said exhaust gas recirculation passageway.

19. A control system as set forth in claim 16, further comprising, an exhaust gas recombustion apparatus connected to said first and second exhaust gas passageways.

* * * * *